United States Patent [19]

Yabe et al.

[11] 4,183,749

[45] Jan. 15, 1980

[54] PHOTOGRAPHIC FILM WITH POLYETHYLENE TEREPHTHALATE-POLYALKYLENE GLYCOL COPOLYMER SUPPORT

[75] Inventors: Kenji Yabe; Atsuhiko Soda, both of Otsu; Satoyuki Minami; Osamu Iida, both of Mishima, all of Japan

[73] Assignees: Fuji Photo Film Co., Ltd., Minami-ashigara; Toray Industries Inc., Nihonbashimuro, both of Japan

[21] Appl. No.: 876,800

[22] Filed: Feb. 10, 1978

[30] Foreign Application Priority Data

Feb. 10, 1977 [JP] Japan ..... 52-12931

[51] Int. Cl.[2] ..... G03C 7/00; G03C 1/40; G03C 1/78; G03C 1/96

[52] U.S. Cl. ..... 430/211; 430/533; 525/227; 428/480

[58] Field of Search ..... 96/76 R, 76 C, 77, 87 R, 96/3, 29 D, 73; 428/480; 260/860

[56] References Cited

U.S. PATENT DOCUMENTS

| | | | |
|---|---|---|---|
| 3,635,707 | 1/1972 | Cole | 96/77 |
| 3,988,157 | 10/1976 | Van Paesschen et al. | 96/87 R |

*Primary Examiner*—Richard L. Schilling
*Attorney, Agent, or Firm*—Sughrue, Rothwell, Mion, Zinn and Macpeak

[57] ABSTRACT

A diffusion transfer photographic film, in which a film of a polyethylene terephthalate copolymer is a part of the constituents thereof, the polyethylene terephthalate containing about 3 to about 20% by weight of a polyalkylene glycol, as a glycol component comonomer, based on the weight of the polyethylene terephthalate copolymer.

31 Claims, 3 Drawing Figures

PHOTOGRAPHIC FILM WITH POLYETHYLENE TEREPHTHALATE-POLYALKYLENE GLYCOL COPOLYMER SUPPORT

BACKGROUND OF THE INVENTION

1. Field of the Invention

This invention relates to a diffusion transfer photographic film which provides an excellent print and which has excellent dimensional stability.

2. Description of the Prior Art

Recently, diffusion transfer photography enabling photographed pictures to be viewed on the spot has spread increasingly due to its convenience.

The structure of diffusion transfer photographic films, in particular, the structure of diffusion transfer color photographic films, more or less varies dependent upon the processes for developing and printing them as described in, for example, *Properties of Films and Processing Arts Therefor* (published by Shashin Kogyo Shuppan Sha, Oct. 15, 1976). In principle, however, the photographic film comprises the constituents necessary for photography, development and printing.

A detailed description and explanation of diffusion transfer photographic films are set forth below.

The so-called diffusion transfer process instant color photographic light-sensitive materials as well known as diffusion transfer photographic films in the photographic art. In these types of materials, diffusible dyes are image-wise released from a light-sensitive element in conformity with the images exposure. Of these materials, film units in which a development processing solution is spread as a thin layer immediately after photographing and which does not require the image-receiving layer to be separated from the light-sensitive element by, e.g., an operation such as delamination, and which permits the composite to be used as a photographic picture are advantageous since they have the advantages that they are handy, their procedure of use is simplified, the development processing solution is not uncovered and, therefore, clothes are not stained by the processing solution, and no waste materials due to delamination are produced. These composite film units are described in U.S. Pat. Nos. 2,983,605, 3,415,645, 3,415,646, 3,415,644, 3,578,540, 3,573,043, 3,615,421, 3,594,164, 3,594,165, 3,620,724, 3,635,707, 3,993,486, British Pat. Nos. 1,269,805, 1,330,524, etc., and are well known.

These composite film units contain, sandwiched between two dimensionally stable supports, light-sensitive silver halide emulsion layers, dye image-providing compounds associated with the silver halide emulsions, an image-receiving layer capable of fixing as an image the diffusible dyes released from the dye image-providing compounds, and a light-reflecting layer which serves as a white background for viewing the image formed in the image-receiving layer. In addition, a container retaining a processing solution is disposed at a given position between the two supports and which is capable of spreading a development-processing solution in a layer state thereon. These constituents are fixed together to form a composite structure. In a preferred embodiment, the film unit has, in sequence from the exposure side, a blue-sensitive silver halide emulsion layer having associated therewith a yellow dye image-providing compound, a green-sensitive silver halide emulsion layer having associated therewith a magenta dye image-providing compound and a red-sensitive silver halide emulsion layer having associated therewith a cyan dye image-providing compound between the two supports, with these silver halide emulsion layers being advantageously separated from each other by interlayers. In addition, the film unit advantageously contains a polymer acid layer for neutralizing alkali brought into the element with the processing solution after substantial completion of a dye image, and a neutralization timing layer for controlling the formation of an image and the rate of neutralization. Further, the film unit advantageously has a light-intercepting layer which permits the film unit to be processed in a bright room after the film unit comes out of the camera. Additionally, the supports may have a backing layer thereon. The most preferred film unit structure comprises, in sequence from the exposure side, (A) a transparent support—a polymer acid layer—a neutralization timing layer—an image-receiving layer—(a processing solution layer containing a light-reflecting material)—a protective layer—a blue-sensitive silver halide emulsion layer—a yellow dye image-providing compound layer—an interlayer—a green-sensitive silver halide emulsion layer—a magenta dye image-providing compound layer—an interlayer—a red-sensitive silver halide emulsion layer—a cyan dye image-providing compound layer—a light-intercepting support; or (B) a transparrent support—a polymer acid layer—a neutralization timing layer—(a processing solution layer containing a light-intercepting material)—a protective layer—a blue-sensitive silver halide emulsion layer—a yellow dye image-providing compound layer—an interlayer—a green-sensitive silver halide emulsion layer—a magenta dye image-providing compound layer—an interlayer—a red-sensitive silver halide emulsion layer—a cyan dye image-providing compound layer—a light-intercepting layer—a light-reflecting layer—an image-receiving layer—a transparent support. Film unit (A) described above is exposed through the transparent support, with the image formed being viewed through the same support, whereas film unit (B) described above is exposed through the transparent support adjacent the polymer acid layer, with the image formed being viewed through the transparent support adjacent the image-receiving layer.

The film unit constituents provided between the two supports are bound at the periphery thereof to maintain the composite film unit form prior to, during and after development processing and prevent the spread processing solution from oozing out of the unit, and the film unit is preferably constructed so that a definite space exists between the two supports in order to spread the processing solution in a given thickness. Further, the film unit preferably has a pod retaining the processing solution which is fixedly positioned at one end thereof and a reservoir for receiving excess processing solution which is fixedly positioned at the opposite end thereof. Various bonding or fixing techniques can be used. Typical examples include (i) adhering the two supports externally with a binding member which embraces the two supports (outer spacer) and (ii) adhering photographic layers between the two supports using a binding member (inner spacer).

FIGS. 1, 2 and 3 show examples of the structures of diffusion transfer photographic films, particularly of diffusion transfer color photographic composite film units. In these figures, the details of emulsion layers, although important in the photographic film, are not shown since they are not necessary to describe the invention, and as a result, these figures illustrate diagrammatic views mainly showing the elements necessary for describing the materials to which the present invention is applicable.

FIG. 1 shows a photographic film of type (A) described above in which the exposure side (A-1) and the print-viewing side (A-2) are on the same side, and FIG. 2 is an enlarged view thereof. In this type of film, transparent film support (1) is on the surface side and black opaque film support (2) is on the back side, with a border (4) of white contact-bonding tape (3). Pod (6) retaining processing solution (5) is attached to the back surface of the lower side of the image layer. Layers between supports (1) and (2) comprise emulsion layer (7), image-receiving layer (8), neutralizing layer (9) for neutralizing the processing solution and processing solution layer (10) to be formed by processing solution (5) released from pod (6) and spread on the image area, and the like. Another example is a photographic film of the type (B) described above wherein the exposure side (B-1) and the print-viewing side (B-2) are on opposite sides of the film as illustrated in FIG. 3. This type of film comprises transparent film supports (1) at the surface and the back side, neutralizing layer (9), processing solution layer (10) to be formed after photographing by processing solution (5) spread from pod (6), emulsion layer (7), light-intercepting black layer (11) and image-receiving layer (8).

After image-wise exposure, these photographic films are passed between rollers to rupture pod (6) retaining processing solution (5) and to spread processing solution (5) over the image area for conducting development and printing. When the photographic films come out of the camera, they are in a sufficiently dry state to be satisfactorily handled, and a printed image gradually becomes distinct to provide a photographic picture in about 5 to 10 minutes.

However, these convenient diffusion transfer photographic films have the following defects in handling after photographing.

(1) The printed surfaces must be handled with care for about 10 minutes after photographing.

(2) It takes such a long time for the water present in the processing solution or the like to escape as a vapor into the atmosphere that the photographic pictures do not easily dry. Thus, a long time is required before the image becomes completely stable.

(3) The photographic pictures obtained cannot be stored in a highly humid place due to reason (2) described above, and hence color change, deformation or blocking with other photographic pictures or with album mounts tends to occur during storage.

With the film unit of, in particular, the inner spacer type as hereinbefore described, the processing solution is not spread on the back of the binding member, and hence a difference occurs in that the central areas (image area) of the two supports come into contact with water of the processing solution, whereas the peripheral area (binding member area) does not come into contact with the water of the processing solution. If the supports are made of a material which will swell to a degree above a certain limit when in contact with water, the area which swells is enclosed in a non-swelling frame, resulting in a distortion of the film unit. With a film unit of the outer spacer type (i), a similar distortion can occur when the binding member is swollen only with difficulty with water and the mechanical strength thereof is larger than a certain limit.

Various techniques have been developed for removing these defects. For example, (1) choosing constituents including emulsion layers and the like of the film so as to minimize the amount of processing solution, and (2) use of a support film having a large water permeability as the surface layer and the back side layer of a photographic film have been suggested. With respect to approach (1) above, a large number of examinations have been made. However, removal of the above-described defects using this approach has not been sufficient. With respect to approach (2), cellulose triacetate films widely used as a support for motion picture film or photographic film have been examined. It is true that a cellulose triacetate film has excellent water permeability and permits water contained in a photographic film to escape as a vapor, but a cellulose triacetate film is not dimensionally stable under high humidity conditions so that the image surface becomes uneven during escape of water damaging the photographic values. Therefore, at present, unavoidably a polyethylene terephthalate film must be used due to its excellent flatness, dimensional stability under high humidity conditions, chemical resistance and transparency despite its unsatisfactory water permeability.

Stabilization of the image has been attempted by rapidly removing the solvent (in many cases water) of the processing solution from the composite film unit. For example, British Pat. No. 1,313,868 describes the use as a support of a polymer layer of cellulose acetate, regenerated cellulose, cross-linked polyvinyl alcohol, or an extremely thin polyester base, a polyester base containing pores permeable to water vapor (the vapor permeability being not less than 100 g/24 hrs·100 $in^2$/mil (corresponding to 394 g/24 hr·$m^2$/0.1 mm), preferably not less than 300 g/24hrs·100 $in^2$/mil (corresponding to 1182 g/24 hr·$m^2$/0.1 mm)). However, the polymer supports specifically described above are not satisfactory for use in a composite film unit due to one of the following defects: (1) the swelling when the polymer supports are in contact with water is so large that the film unit form will be affected when a development processing solution is spread; (2) the deficiency in mechanical strength due to the very thin thickness makes it difficult to coat a photographic layer thereon or to uniformly spread the processing solution; (3) the polyester base containing fine pores (e.g., having a size of 23–107 $\mu$) is optically opaque, and hence image-wise exposure through such a support or viewing images through such a support is actually difficult. In particular, with a film unit having a structure where swelling with water is restricted by at least one end of the film unit, a dimensional lack of balance will occur between the image area which swells when in contact with water and the end area which does not swell even in contact with water where a weakly hydrophilic support like cellulose acetate as described above is used. In such a case, the film unit will be seriously deformed after spreading the processing solution, and this deformation remains even after the processing solution is dried away to such a degree that the resulting photograph cannot be satisfactorily utilized any more. In addition, supports with insufficient transparency cannot be used for film unit (B) described above which is a particularly preferable type.

SUMMARY OF THE INVENTION

As a result of various investigations for removing these defects of diffusion transfer photographic films, on examination of support films, it has now been discovered that the use of a polyester film having substantially the same excellent properties as that of a conventional polyethylene terephthalate film in terms of flatness, dimensional stability under high humidity conditions, chemical resistance and transparency and having improved water permeability and film adhesiveness removes the above-described defects, and thus the present invention has been achieved.

That is, the present invention provides a diffusion transfer photographic film, in which a polyester film is used as one of the constituents of the film, with the polyester film comprising a film of a polyethylene terephthalate copolymer containing about 3 to about 20% by weight of a polyalkylene glycol, as a glycol component comonomer, based on the weight of the polyethylene terephthalate copolymer.

BRIEF DESCRIPTION OF THE DRAWINGS

FIG. 1 shows one example of the structure of a diffusion transfer photographic film, and FIG. 2 shows a part of enlarged view of the photographic film of FIG. 1.

FIG. 3 shows a part of another example, enlarged as in FIG. 2, of a diffusion transfer photographic film.

Figure 1:
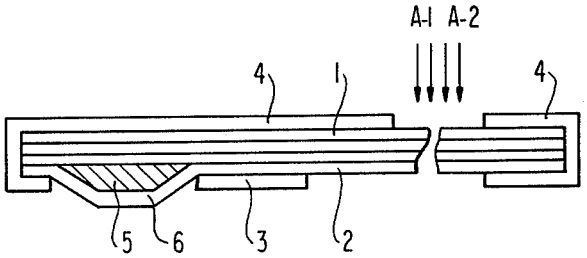
FIGS. 1, 2 and 3 are cross-sectional views showing the structures of diffusion transfer photographic films. Although actual photographic films comprise multicoated layers for various purposes, base film layers, etc., these figures are only diagrammatic views sufficient to illustrate the present invention.

In these figures, numeral 1 designates a transparent film base, 2 a black and opaque film base, 3 a white contact bonding tape, 4 a border formed by the white contact bonding tape 3, 5 a processing solution necessary for development and printing, 6 a pod retaining the processing solution, 7 an emulsion layer, 8 an image-receiving layer, 9 a neutralizing layer, 10 a processing solution layer spread after photographing, 11 a black light-intercepting layer, A-1, B-1 the exposure side, and A-2, B-2 the print-viewing side.

DETAILED DESCRIPTION OF THE INVENTION

The phrase "part of the constituents" as used herein means that the polyester film described above is used as a part of or all of one or more constituents where form-maintaining ability is required and is essential such as transparent film bases at the surface and the back side of a photographic film, an opaque black film base to be used as a light-intercepting layer, a bordering for a photographic picture, a spacer between film bases, a support of the photographic film, a base for a coating layer in the photographic film, e.g., an emulsion layer and the like.

The polyester film in accordance with the present invention must have a water vapor permeability and a humidity swelling coefficient within the scope specified in the present invention. Further, polyester films in accordance with the present invention to be used as the constituents which must have a good transparency, must have a haze of not more than about 10% per sheet, preferably not more than 5%. The polyester films referred to in the present invention desirably have a Young's modulus of not less than about 250 kg/mm$^2$, preferably not less than 300 kg/mm$^2$ (the average of the value of the Young's modulus in the longitudinal direction and the value of the Young's modulus in the transverse direction of the film).

If the water vapor permeability at 60° C. is less than about 10 g/m$^2$·24 hr/0.1 mm, water in a photographic film scarcely escapes as a vapor due to the poor water permeability, and hence the photographic pictures do not dry easily and as long as more than 1 month is necessary for the image to become completely stable. On the other hand, if the water vapor permeability at 60° C. is more than about 100 g/m$^2$·24 hr/0.1 mm, water escapes as vapor in such a short time that the surface of the photographic picture becomes uneven or deformation of the photographic picture takes place. If the humidity swelling coefficient at 20° C. is less than about $1.0\times10^{-5}$/% RH, the dimensional change of layers other than the polyester film layer, such as the emulsion layers, than the polyester film layer becomes so much larger than that of the polyester film that the polyester films must be thick in order to maintain the dimensional stability of the photographic pictures. On the other hand, if the humidity swelling coefficient at 20° C. is more than about $6.0\times10^{-5}$/% RH, the dimensional change of the polyester film itself becomes so large that the photographic picture becomes curved or distorted.

Specific examples of polyester films which can be used in the present invention having the above-described properties are films of polyethylene terephthalate copolymers prepared by copolymerizing terephthalic acid with ethylene glycol and a polyalkylene glycol as glycol component comonomers, with the polyalkylene glycol being present in an amount of about 3 to 20% by weight, preferably 3 to 15% by weight, based on the weight of the polyethylene terephthalate copolymer produced and with the polyalkylene glycol having a molecular weight of about 300 to 30,000, preferably 800 to 20,000. Biaxially oriented films are particularly preferable. Typical examples of the polyalkylene glycols which can be used include those having 2 to 4 carbon atoms in the alkylene moiety such as polyethylene glycol (PEG), polypropylene glycol (PPG), poly(ethylene·propylene) glycol copolymer, polytetramethylene glycol (PTMG), etc.

In this case, if the molecular weight of the polyalkylene glycol used for the copolymerization is less than about 300, the mechanical properties become poor, although there are no problems as to the water vapor permeability and the humidity swelling coefficient. On the other hand, if the molecular weight of the polyalkylene glycol is more than about 30,000, defects occur such as the water permeability is low for the copolymerization amount of the polyalkylene glycol and that transparency is reduced, often resulting in the formation of a milky film. Also, if the amount of the polyalkylene glycol copolymerized is less than about 3% by weight, the water vapor permeability and the humidity swelling coefficient are not improved very much. If the amount copolymerized exceeds about 20% by weight, the equilibrium adsorption moisture content of the polyester is so high and the resulting film is so hygroscopic that the problem of susceptibility to heat and thermal decomposition upon melt-extrusion and the problem of coloration occur. In addition, photographic properties of the film prepared using such a polyester have the defect that, when the film is left in a highly humid area, the film absorbs water from the surrounding atmosphere.

Where PEG is used as the polyalkylene glycol, a PEG having a molecular weight of about 300 to 10,000, in particular 800 to 6,000, is preferred. Where the polyester is to be used as a part where transparency is important, a PEG with a molecular weight of 800 to 2,000 is particularly preferred. A suitable amount of these PEG's copolymerized is about 3 to 15% by weight, particularly preferably 4 to 10% by weight. Where a poly(ethylene·propylene) glycol copolymer is used as the polyalkylene glycol, a preferred molecular weight ranges from about 500 to 30,000, particularly preferably 1,000 to 20,000, and the amount copolymerized ranges from about 3 to 15% by weight, particularly preferably 4 to 10% by weight. Where PTMG is used as the polyalkylene glycol, a preferred molecular weight ranges from about 500 to 2,000, particularly preferably from 800 to 1,500, and a preferred amount copolymerized ranges from about 4 to 18% by weight, particularly preferably 5 to 15% by weight.

Of these polyalkylene glycols, PEG is particularly preferred in copolymerization ratio, water permeability and dimensional stability under high humidity conditions.

The above-described specific examples of polyesters are mainly polyesters comprising, as an acid component, terephthalic acid and, as a glycol component, ethylene glycol and polyalkylene glycol. In the present invention, however, those polyesters which contain, as the acid component, dicarboxylic acids such as aromatic or aliphatic dicarboxylic acids (e.g., isophthalic acid, adipic acid, sebacic acid, etc.) and, as the glycol component, diols such as diethylene glycol, 1,4-butanediol, cyclohexanedimethanol, pentanediol, hexanediol, etc., in amounts of these other dicarboxylic acids and other diols which do not cause a deterioration of film properties intended in the present invention, in particular, a reduction in haze and in the mechanical properties, preferably in a copolymerization amount of less than about 10 mol%, may also be used.

To the copolymer polyesters used in the present invention may be added, if desired, an antioxidant, a lubricant, an antistatic agent, a coloration-preventing agent, a pigment, a dye and a viscosity-adjusting agent. In particular, addition of an antioxidant, in particular, a hindered phenol antioxidant, in an amount of about 0.005 to 0.5% by weight, preferably 0.01 to 0.3% by weight is preferred. For example, "Irganox" 1010 (trade name, produced by Ciba-Geigy Co.) is particularly effective. In addition, where the polyester is to be employed also as a light-intercepting layer, the use of carbon black fine particles in an amount of about 0.1 to 5% by weight, although the amount of carbon black will vary depending upon the film thickness, is effective.

In addition, known polymers can be blended with the polyester to be used in this invention depending on the end-use in an amount which does not detrimentally influence the polyester as a base for photographic films. For example, a modified ester obtained by subjecting polyethylene terephthalate to an ester exchange reaction with diols or polyalkylene glycols such as diethylene glycol, triethylene glycol, polyethylene glycol, etc., can be blended in an amount of about 1 to 10% by weight, preferably 3 to 8% by weight, with the polyester to be used in this invention to enhance water permeability.

The polyester film to be used in the present invention is obtained by biaxially orienting an unoriented film which can be produced using conventional melt-extrusion processes. More specifically, to illustrate one example of a process for forming a film of the polyester film to be used in the present invention, an unoriented film melt-extruded at about 260° C. to 300° C. is oriented about 2.7 to 3.7 times at about 70° to 100° C. in the longitudinal direction of the film using a roll-type longitudinal orientation machine, and then fed to a tenter to orient the film about 2.7 to 3.7 times at about 80 to 120° C. in the transverse direction. Subsequently, the film so treated is subjected to a heat treatment at about 150° C. to 5° C. below the melting point of the polymer under conditions preventing shrinkage of the film or allowing some shrinkage of the film to prepare a biaxially oriented film.

The thickness of the polyester film to be used in the present invention will vary depending on the part for which it is used but, in general, a suitable thickness is about 25 to 250$\mu$, preferably 75 to 150$\mu$.

The polyester film to be used in the present invention has the characteristics that, as compared with conventional polyethylene terephthalate films, the adhesiveness of the surface and the adhesiveness with various coating layers such as an emulsion layer are improved.

Figure 2:
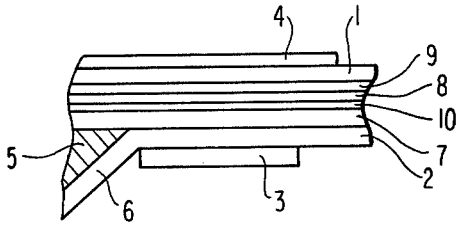
Figure 3:
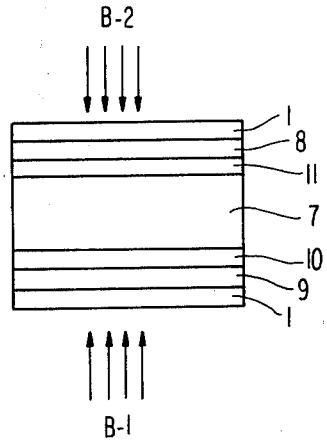

The present invention is particularly applicable to the diffusion transfer instant color photographic light-sensitive materials described hereinbefore, e.g., for the type (A) and of the type (B) described hereinbefore and as shown in FIGS. 1 to 3.

It has been discovered that the following properties can be imparted to diffusion transfer process instant photographic films by using a polyester base of the present invention having an intermediate water vapor permeability and a low humidity swelling coefficient.

(1) Water brought into the film unit with the spread processing solution is rapidly removed from the film unit. As a result of this drying, migration of excess diffusible dyes after formation of the image is depressed, and the tendency of the white background of photographic pictures to be stained during storage or the tendency of the color image gradation to change due to "post transfer" is minimized.

(2) The degree of discoloration and the degree of fading (during storage in a dark place and upon being struck with light) are low. The reason for this is not fully understood, but it may be attributed to the fact that a dry condition is not conducive to discoloration reactions and fading reactions or the fact that the components in the film unit which accelerate the discoloring and fading reactions are prevented from migrating to the image-receiving layer.

(3) The film unit of the present invention is not distorted and retains a good flatness during processing and storage of images, i.e., during the period where water is present or in a dry state. This property is maintained even when the film unit contains, at an end or ends, a part or parts which do not swell even in contact with water.

(4) Image-wise exposure or image-wise viewing through the film base is possible without substantially affecting the image quality. This enables the production of film unit (B) described above which is a particularly preferred type. This is due to the high transparency of the film base of the present invention.

(5) It has become possible to provide the film base with the necessary mechanical strength (rigidity) for spreading the processing solution as a thin layer. Thus, the processing solution can be uniformly spread. This is due to the high transparency of the film base material, which results in the ability to employ the necessary thickness for spreading the processing solution.

Various dye image-providing materials heretofore known for diffusion transfer color photographic processes can be used in the film unit of the present invention. Examples include those compounds which undergo a change in diffusibility of the dyes, dye precursors or dye-forming moieties thereof as a result of the oxidation reaction accompanying the development of silver halide, for example, those described in U.S. Pat. Nos. 3,227,550, 3,844,785, 3,620,730, 3,719,489, 2,983,606, 3,928,312, 4,055,428, 3,942,987, 3,954,476, 3,993,638, 4,013,633, British Pat. No. 1,464,104, Japanese Patent Application (OPI) No. 104,343/76, etc. In particular, dye developers of the type described in *Neblette's Handbook of Photography and Reporgraphy,* 7th Ed., pp. 259–330 (1977) and dye releasers of the type described in *Phot. Sci. Eng.,* 20, 155 (1976) can advantageously be used in the present invention.

Various silver halide emulsions of the types corresponding to dye image-providing materials to be associated therewith can be used in the film unit of the present invention. That is, in order to obtain positive images, negative type emulsions are used for such dye image-providing materials as dye developers, and direct-positive type emulsions, in particular, internal latent image-forming type emulsions as described in U.S. Pat. Nos. 3,317,322, 2,592,250, 3,761,276, 3,761,266 and 3,761,267 are used for dye releaser type image-providing materials. These can be sensitized, color sensitized and stabilized using various known techniques.

A development processing solution capable of developing an exposed silver halide emulsion in a film unit and causing formation and transfer of diffusible dyes is used in the film unit of the present invention. This processing solution is an aqueous solution containing the components necessary to cause these photographic processes to occur. For example, the development processing solution contains an alkali agent, an auxiliary developing agent, a development accelerator, an antifogging agent, an antioxidant, etc. In addition, the processing solution may contain a thickening polymer facilitating the spreading of the processing solution in a thin layer such as hydroxyethyl cellulose and carboxymethyl cellulose, an opacifying agent, etc. After exposure, the processing solution is uniformly spread in a liquid thickness of about 30 to 180$\mu$ in the film unit. The processing solution is advantageously retained in a rupturable container, generally called a pod, and released from the container by a means for spreading the processing solution equipped in a camera such as a pair of juxtaposed pressure-applying rollers. The amount of water brought into a film unit with the processing solution will vary depending upon the composition of the processing solution and the thickness of the solution spread but, roughly speaking, the amount of water ranges from about 25 g/m$^2$ to about 180 g/m$^2$.

A particularly preferred embodiment of this invention is a film unit comprising:

(a) a photosensitive element comprising a transparent support having thereon the following layers in sequence: an image-receiving layer; an alkaline solution-permeable light-reflecting layer; an alkaline solution-permeable opaque layer; a red-sensitive silver halide emulsion layer having a cyan dye image-providing compound associated therewith; an interlayer; a green-sensitive halide emulsion layer having a magenta dye image-providing compound associated therewith; an interlayer; a red-sensitive silver halide emulsion layer having a yellow dye image-providing compound associated therewith; and a protective layer;

(b) a cover sheet superposed on the protective layer of the photosensitive element and comprising a transparent support coated in sequence with a neutralizing layer and a neutralization timing layer; and (c) a rupturable container retaining an aqueous alkaline processing composition and an opacifying agent, the rupturable container being so positioned during the processing of the film unit that a compressive force applied to the rupturable container causes a discharge of the alkaline processing composition between the cover sheet and the protective layer of the photosensitive element.

A detailed description of the elements used in this film unit, i.e., photosensitive element, cover sheet, processing composition, rupturable container, is given in U.S. Pat. Nos. 4,056,394 and 4,061,496.

The surface of the film base to be used in the present invention can be advantageously subjected to various processings known in the photographic art in order to strongly adhere the photographic layers to be provided thereon containing a hydrophilic binder, such as processing to render the surface of the film base hydrophilic using an ultraviolet light treatment, a corona discharge treatment, a flame treatment and formation of an adhesive polymer (subbing) layer thereon. This film base advantageously contains a slight amount of a pigment or a dye so as to prevent light-piping through the base when the film unit is withdrawn from the camera. This film base advantageously has a thickness of from about 50 to 250$\mu$ to provide sufficient mechanical strength to support the photographic layers of the film unit and enable the processing solution to be uniformly spread thereon.

The methods of measurement of the characteristics of the polyester film employed in this invention are described in detail below.

Water Vapor Permeability

Measured at 40° C. according to JIS Z-0208.

Humidity Swelling Coefficient

A constant load extensometer (made by Nippon Jidosha Seigyo K.K., Model ITL-2) was placed in a thermostatically and humidistatically controlled chamber where the temperatures of such could be changed over a broad range, and a load of 2.5 g/cm width was applied to a sample film (150 mm in length by 10 mm in width). The relative humidity was changed at 20° C. within the range of 40 to 80% RH, and the humidity swelling coefficient was determined from the extension in the length of the film versus humidity. Humidity was measured using an Assmann aspiration psychrometer.

Photographic Film

Sample photographic films were prepared according to the process described in Japanese Patent Publication No. 16,356/71 and, after photographing, developing and printing, the photographic films were left in an atmosphere of a temperature of 20° C. and a humidity of 65% RH. The reduction in moisture content was determined by the weight loss and the flatness of the image areas and the dimensional change such as distortion of the entire films were observed visually.

The following examples are given to illustrate the present invention in greater detail. Unless otherwise indicated herein, all parts, percents, ratios and the like are by weight.

EXAMPLE 1

Various polyethylene terephthalate copolymers were prepared by copolymerizing 8.0% by weight of polyethylene glycol (PEG) having a molecular weight of 800–20,000 with terephthalic acid. The copolymers were fed to a 40 mm $\phi$ extruder and melt-extruded at 280° C. to form films. After longitudinally orienting 3.3 times at 80° C., the films were transversely oriented 3.5 times at 90° C. using a tenter and subjected to heat treatment at 200° C. while preventing shrinkage to prepare biaxially oriented films of a thickness of 100$\mu$. For comparison, a biaxially oriented film of a non-copolymerized conventional polyethylene terephthalate film was also prepared. The characteristic properties of each film are tabulated in Table 1 below.

TABLE 1

| Film No. | Molecular Weight of PEG | (1) Intrinsic Viscosity | Haze (%) | Water Vapor Permeability ($g/m^2 \cdot 24$ hr/0.1 mm) | Humidity Swelling Coefficient ($\times 10^{-5}$/% RH) | (2) Young's Modulus MD (kg/mm$^2$) | (2) Young's Modulus TD (kg/mm$^2$) |
|---|---|---|---|---|---|---|---|
| 1 | 800 | 0.65 | 2.0 | 19.5 | 2.4 | 330 | 350 |
| 2 | 1,000 | 0.63 | 2.1 | 18.0 | 2.3 | 325 | 340 |
| 3 | 2,000 | 0.65 | 2.1 | 18.1 | 2.3 | 340 | 345 |
| 3' | 2,000 | 0.65 | — | 19.0 | 2.2 | 348 | 356 |
| 4 | 6,000 | 0.69 | 2.4 | 17.5 | 2.1 | 346 | 350 |
| 5 | 10,000 | 0.68 | 2.7 | 15.3 | 2.0 | 350 | 362 |
| 6* | 20,000 | 0.65 | 10.5 | 12.1 | 1.8 | 358 | 365 |
| 7* | — | 0.62 | 1.8 | 5.0 | 0.7 | 380 | 400 |

(1) : Intrinsic viscosity measured in 25° C. in o-chlorophenol.
(2) : MD: longitudinal direction; TD; transverse direction.
*Comparative examples.

The film sample prepared using a PEG having a molecular weight of 20,000 was opaque and, therefore, was unsuitable for use as a photographic base. It was found that Films No. 1 to No. 5 had a water permeability at least three times greater than that of the conventional polyethylene terephthalate and thus these Films No. 1 to No. 5 had excellent water permeability. Then, Films No.1 to No.5 and No.7 were used as film base (1) as shown in FIG. 1 and a light-intercepting film No.3 prepared in the same manner except for using 1.2% by weight of carbon black was used as black film base (2) to prepare photographic films. These films were printed after photographing. The resulting photographic pictures were left at 20° C. and 65% RH to evaluate the reduction in moisture content. Photographic film prepared using Films No.1 to No.5 of the present invention allowed moisture to escape as a vapor almost completely in about 10 days to provide photographic pictures having good flatness and capable of being stored for a long time. The photographic film prepared using Film No. 7 required longer than 30 days to become dry and had a poor long-term storability.

EXAMPLE 2

Polyethylene terephthalate copolymers containing 3, 10, 15 and 20% by weight of PEG with a molecular weight of 1,000 were formed into biaxially oriented films of at thickness of 100$\mu$ in the same manner as in Example 1. The properties of these films are shown in Table 2 below.

TABLE 2

| Film No. | Copolymerization Amounnt of PEG (wt %) | Haze (%) | Young's Modulus MD (kg/mm$^2$) | Young's Modulus TD (kg/mm$^2$) | Water Vapor Permeability ($g/m^2 \cdot 24$ hr/0.1 mm) | Humidity Swelling Coefficient ($\times 10^{-5}$/% RH) |
|---|---|---|---|---|---|---|
| 8 | 3 | 1.9 | 360 | 385 | 11.0 | 1.2 |
| 9 | 10 | 2.5 | 280 | 330 | 23.8 | 2.4 |
| 10 | 15 | 4.8 | 253 | 290 | 38.0 | 3.5 |
| 11* | 20 | 11.0 | 236 | 258 | 61.2 | 6.3 |

*Comparative example

Films No.8, 9 and 10 were transparent films having good film-forming properties and, when used as transparent bases for color photographic films in the same manner as in Example 1, about 15 days, 10 days and 6 days, respectively, were required for Films 8, 9 and 10 for moisture to escape as a vapor, and photographic pictures with good flatness were obtained. On the other hand, the photographic film prepared using Film No. 11 became colored upon melt-extrusion due to the large PEG copolymerization ratio, and only an opaque film was obtained. This film had a large water vapor permeability, but it also had a large humidity swelling coefficient and provided photographic pictures with uneven surfaces and poor flatness.

COMPARATIVE EXAMPLE 1

A photographic film was prepared in the same manner as in Example 1 using a cellulose triacetate film (100$\mu$ thickness) prepared using a solvent-casting process to evaluate the film. With a cellulose triacetate single film, the water vapor permeability was 450 $g/m^2 \cdot 24$ hr/0.1 mm, the humidity swelling coefficient was $7.0 \times 10^{-5}$ /% RH, and the Young's modulus was 310 kg/mm$^2$. Moisture escaped as a vapor from the photographic film in a short time of about 2 days, but the surface became uneven, resulting in a distorted photographic picture.

EXAMPLE 3

Carbon black was added in an amount of 1.0% by weight to a polyethylene terephthalate copolymer (intrinsic viscosity: 0.73) containing 15% by weight of PEG with a molecular weight of 1,000, and the copolymer with the carbon black was extruded. Then, the resulting unoriented film was longitudinally oriented 3.3 times at 85° C., and then transversely oriented 3.3 times at 90° C., followed by heat treatment at 210° C. while preventing shrinkage to obtain a biaxially oriented film (No.12) having a thickness of 115μ and a light-intercepting property. This film had a Young's modulus of 270 (MD) and 280 kg/mm$^2$ (TD), a water vapor permeability of 41.3 g/m$^2$·24 hr/0.1 mm, and a humidity swelling coefficient of $3.1\times10^{-5}$ /% RH. This Film No.12 was used as film (2) in FIG. 1 and Film No.2 in Example 1 was used as film (1) in FIG. 1 to prepare a photographic film. When this film was tested, moisture escaped as a vapor in about 5 days, leaving a clear photographic picture with good flatness.

EXAMPLE 4

A polyethylene terephthalate copolymer containing 6% by weight of PEG with a molecular weight of 1,000 was blended in varying amounts with a modified polyester (density: 1.34 g/cm$^3$ (23° C.); softening point: 125° C.; melt index: 13 g/10 min.) obtained by an ester-exchange reaction with polyethylene glycol and diethylene glycol, and 0.1 wt% of "Irganox" 1010 (made by Ciba-Geigy Co.) was added thereto as an antioxidant, followed by pelletizing to uniformly blend the materials. The resulting blend was melt-extruded at 270° C. to form a film, and the extruded film was longitudinally oriented 3.5 times at 80° C., subsequently transversely oriented 3.5 times at 85° C. using a tenter, followed by heat treatment at 200° C. under 1% relaxation to obtain a biaxially oriented film having a thickness of 75μ. Blending with the modified polyester improved water permeability substantially without degrading the transparency.

The properties of the films are shown in Table 3 below.

TABLE 3

| Film No. | Modified Polyester (wt. %) | Haze (%) | Water Vapor Permeability (g/m$^2$ . 24 hr/0.1 mm) | Humidity Swelling Coefficent ($\times10^{-5}$ /% RH) |
|---|---|---|---|---|
| 13 | 0 | 1.9 | 14.3 | 1.8 |
| 14 | 5 | 2.0 | 15.8 | 2.0 |
| 15 | 10 | 2.0 | 17.5 | 2.4 |

A photographic film was prepared in the same manner as in Example 1 to measure the water escape rate. Thus, with photographic Films No. 13, 14 and 15, 11 days, less than 11 days and 10 days, respectively, were required for water to escape as a vapor. The flatness of the surfaces of the photographic pictures did not change upon escape of water, and photographic films capable of being stored for a long period of time were obtained.

EXAMPLE 5

Subbing layers of a thickness of 0.3μ were provided on both sides of the biaxially oriented polyester film base having a thickness of 150μ as described in Example 1, and a backing layer of cellulose diacetate of a thickness of 10μ was provided on the back side. Then, the following photographic layers were coated in sequence to complete a light-sensitive element.

(1) Image-Receiving Layer

A layer comprising 3 g/m$^2$ of a mordant of copoly-(styrenevinyl benzene-tri-n-hexylbenzylammonium chloride) and 3 g/m$^2$ of gelatin.

(2) Light-Reflecting Layer

A layer comprising 20 g/m$^2$ of titanium dioxide and 2 g/m$^2$ of gelatin.

(3) Light-Intercepting Layer

A layer comprising 2.7 g/m$^2$ of carbon black and 2.7 g/m$^2$ of gelatin.

(4) Cyan Color Image-Providing Material Layer

A layer containing 0.5 g/m$^2$ of a cyan color image-providing compound, Compound (P), 0.25 g/m$^2$ of N,N-diethyllaurylamide and 1.14 g/m$^2$ of gelatin.

(5) Red-Sensitive Internal Latent Image Forming Type Emulsion Layer

A layer containing silver bromide (1.9 g silver/m$^2$), 28 mg/m$^2$ of a fogging agent, Compound (S), 0.14 g/m$^2$ of sodium pentadecylhydroquinonesulfonate, and 1.4 g/m$^2$ of gelatin.

(6) Interlayer

A layer comprising 0.8 g/m$^2$ of 2,5-di-tert-pentadecylhydroquinone and 2.6 g/m$^2$ of gelatin.

(7) Magenta Color Image-Providing Material Layer

A layer containing 0.45 g/m$^2$ of a magenta color image-providing compound, Compound (Q), 0.10 g/m$^2$ of N,N-diethyllaurylamide and 1.1 g/m$^2$ of gelatin.

(8) Green-Sensitive Internal Latent Image Forming Type Emulsion Layer

A layer containing 28 mg/m$^2$ of a fogging agent, Compound (S), 0.14 g/m$^2$ of sodium pentadecylhydroquinonesulfonate and 1.4 g/m$^2$ of gelatin.

(9) Interlayer

A layer comprising 0.8 g/m$^2$ of 2,5-di-tert-pentadecylhydroquinone and 2.6 g/m$^2$ of gelatin.

(10) Yellow Color-Providing Material Layer

A layer containing 0.8 g/m$^2$ of a yellow color image-providing compound, Compound (R), 0.16 g/m$^2$ of N,N-diethyllaurylamide and 0.8 g/m$^2$ of gelatin.

(11) Blue-Sensitive Internal Latent Image Forming Type Emulsion Layer

A layer containing silver bromide (1.9 g silver/m$^2$), 28 mg/m$^2$ of a fogging agent, 0.14 g/m$^2$ of sodium pentadecylhydroquinonesulfonate and 1.4 g/m$^2$ of gelatin.

(12) Protective Layer

A layer comprising 0.9 g/m$^2$ of gelatin.

These photographic layers were hardened with 1,3-bisvinylsulfonyl-2-propanol.

The compounds used in preparing the above layers had the following formulas.

Compound (P)

-continued

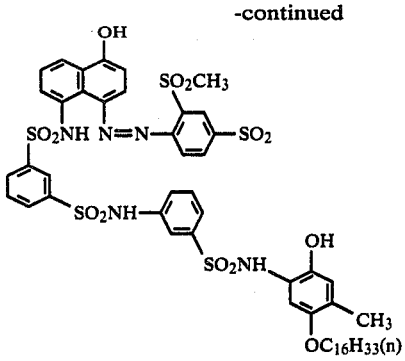

Compound (Q)

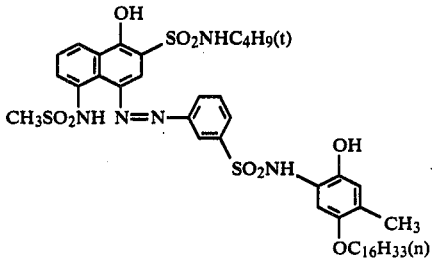

Compound (R)

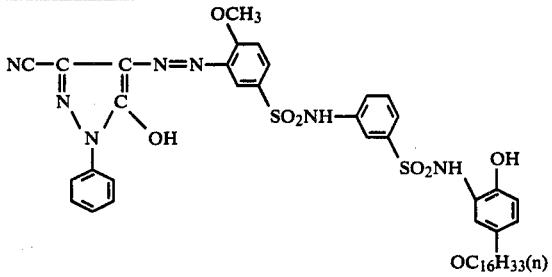

Compound (S)

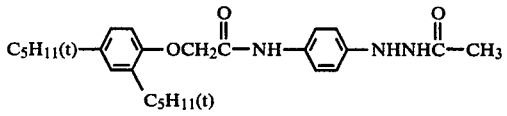

Subbing layers having a thickness of 0.3μ were provided on both sides of a biaxially oriented film base of a thickness of 100μ of the polyester described in Example 1, and a backing layer comprising cellulose diacetate having a thickness of 7μ was provided on the back side. Then, the following photographic layers were coated in sequence to complete a cover sheet.

(1) Polymer Acid Layer

A layer comprising 25 g/m² of an n-butylacrylic acid-/acrylic acid copolymer (mol. wt.: about 70,000; 3:7 wt. ratio).

(2) Neutralization Timing Layer

A layer comprising 3.8 g/m² of cellulose acetate (acetylation degree: 39.4%) and 0.2 g/m² of copoly(styrene-maleic anhydride).

Further, a processing solution having the following composition was prepared and sealed in a pod.

| | | |
|---|---|---|
| 1-Phenyl-4-methyl-4-hydroxymethyl-3-pyrazolidine | 10 | g |
| Methylhydroquinone | 0.18 | g |
| 5-Methylbenzotriazole | 4.0 | g |
| Sodium Sulfite (anhydrous) | 1.0 | g |
| Sodium Carboxymethyl Cellulose | 40 | g |
| Carbon Black | 150 | g |
| Potassium Hydroxide | 50 | g |
| Water | 550 | g |

The thus-prepared light-sensitive sheet, the cover sheet and the processing solution-retaining pod were disposed as described in U.S. Pat. No. 4,042,395 to prepare a film unit. That is, in order to ensure a space of a thickness of 125μ between the light-sensitive sheet in a rectangular form and the cover sheet, polyester strips were heat-sealed to one pair of opposing sides of the light-sensitive sheet and the cover sheet, and the processing solution-retaining pod and an excess solution reservoir were fixedly positioned at each of the other pair of opposing ends.

This film unit was subjected to color photographic sensitometry through the cover sheet, and passed between a pair of pressure-applying metal rollers to spread the processing solution in a solution thickness of about 100μ between the light-sensitive sheet and the cover sheet. A color image with good color separation was formed about 10 minutes after spreading the processing solution.

A corresponding comparative film unit was prepared under the same conditions as described above except for using a conventional biaxially oriented polyethylene terephthalate film of the same thickness as a film base, and processed in the same manner. Thus, a color image with as good a color separation as that of the above-described film unit was obtained.

These film units were left under the conditions of 20° C. and 65% RH, and the amount of water escape as vapor from the film unit was determined by measuring the weight loss. Thus, it was found that, with the film unit of the present invention and the comparative film unit using a conventional type polyester film base, it took 10 days and about 28 days, respectively, for water in the processing solution to escape as vapor. These two film units showed good flatness during processing and storage.

Another two pairs of the film units similarly prepared and processed were subjected to color image-fading testing on and after the third day from their processings to obtain the following results.

TABLE 4

| Sample | Fading Test | Fading Degree (3) B Density | G Density | R Density |
|---|---|---|---|---|
| Film Unit of the Invention | Fading with Light (1) | −0.08 | −0.05 | −0.35 |
| | Fading in a Dark Place (2) | −0.03 | −0.10 | +0.02 |
| Film Unit for Comparison | Fading with Light (1) | −0.10 | −0.25 | −0.50 |
| | Fading in a | −0.08 | −0.25 | +0.05 |

TABLE 4-continued

| Sample | Fading Test | Fading Degree (3) | | |
|---|---|---|---|---|
| | | B Density | G Density | R Density |
| | Dark Place (2) | | | |

(1) Conditions of fading with light: irradiation with light of about 15,000 lux emitted from a day-light fluorescent lamp at about 35° C. for 7 days.
(2) Conditions for fading in a dark place: storage for 14 days in a well-circulated air thermostatically controlled chamber at 60° C. and 60% RH.
(3) Difference in density occurring on test based on an initial density of 1.5.

The above results clearly show that the film unit of the present invention can be rapidly dried after processing while maintaining good flatness and that the color images formed therein are fast and undergo less change in density.

While the invention has been described in detail and with reference to specific embodiments thereof, it will be apparent to one skilled in the art that various changes and modifications can be made therein without departing from the spirit and scope thereof.

What is claimed is:

1. A diffusion transfer photographic film which comprises a support, a silver halide layer and an image receiving layer, in which a film of a polyethylene terephthalate copolymer is a part of the constituents thereof, said polyethylene terephthalate copolymer containing about 3 to about 20% by weight of a polyalkylene glycol having a molecular weight of about 300 to about 30,000, as a glycol component comonomer, based on the weight of the polyethylene terephthalate copolymer.

2. The diffusion transfer photographic film as described in claim 1, wherein said polyalkylene glycol is present in a copolymerization ratio of 3 to 15% by weight.

3. The diffusion transfer photographic film as described in claim 1, wherein said polyalkylene glycol has a molecular weight of about 800 to about 20,000.

4. The diffusion transfer photographic film as described in claim 2, wherein said polyalkylene glycol has a molecular weight of about 800 to about 20,000.

5. The diffusion transfer photographic film as described in claim 1, wherein said polyalkylene glycol is selected from the group consisting of polyethylene glycol, polypropylene glycol, poly(ethylene-propylene)-glycol copolymer and polytetramethylene glycol.

6. The diffusion transfer photographic film as described in claim 5, wherein said polyalkylene glycol is polyethylene glycol and the polyethylene glycol is present in a copolymerization ratio of 4 to 10% by weight.

7. The diffusion transfer photographic film as described in claim 6, wherein said polyethylene glycol has a molecular weight of about 300 to about 10,000.

8. The diffusion transfer photographic film as described in claim 7, wherein said polyethylene glycol has a molecular weight of about 800 to about 6,000.

9. The diffusion transfer photographic film as described in claim 8, wherein said polyethylene glycol has a molecular weight of about 800 to about 2,000.

10. The diffusion transfer photographic film as described in claim 2, wherein said polyalkylene glycol is selected from the group consisting of polyethylene glycol, polypropylene glycol, poly(ethylene-propylene) glycol copolymer and polytetramethylene glycol.

11. The diffusion transfer photographic film as described in claim 8, wherein said polyalkylene glycol is polyethylene glycol and the polyethylene glycol is present in a copolymerization ratio of 4 to 10% by weight.

12. The diffusion transfer photographic film as described in claim 11, wherein said polyethylene glycol has a molecular weight of about 300 to about 10,000.

13. The diffusion transfer photographic film as described in claim 12, wherein said polyethylene glycol has a molecular weight of about 800 to about 6,000.

14. The diffusion transfer photographic film as described in claim 13, wherein said polyethylene glycol has a molecular weight of about 800 to about 2,000.

15. The diffusion transfer photographic film as described in claim 1, wherein said film of a polyethylene terephthalate copolymer contains an antioxidant.

16. The diffusion transfer photographic film as described in claim 13, wherein said antioxidant is a hindered phenol compound.

17. The diffusion transfer photographic film as described in claim 1, wherein a film of said polyethylene terephthalate copolymer is a biaxially oriented film of said polyethylene terephthalate copolymer.

18. The diffusion transfer photographic film as described in claim 1, wherein said film of a polyethylene terephthalate copolymer has a water vapor permeability at 40° C. of about 10 to 100 $g/m^2 \cdot 24$ hr/0.1 mm and a humidity swelling coefficient at 20° C. of about $1.0 \times 10^{-5}$ to $6.0 \times 10^{-5}$/% RH.

19. A composite diffusion transfer unit adapted for use in a photographic diffusion transfer process comprising two dimensionally stable supports at least one of which is transparent having sandwiched therebetween at least:

(i) at least one light-sensitive silver halide emulsion layer;

(ii) at least one dye image-forming compound associated with each of said at least one silver halide emulsion layer and capable of image-wise forming a diffusible dye as a result of the development of said at least one silver halide emulsion layer;

(iii) an image-receiving layer capable of fixing the image-wise formed diffusible dye as a photographic image; and (iv) a light-reflecting layer forming a background for viewing the image formed in said image-receiving layer and a container retaining an aqueous alkaline processing solution to be spread between said supports, and wherein at least one of said dimensionally stable supports comprises a film of a polyethylene terephthalate copolymer containing about 3 to about 20% by weight of a polyalkylene glycol having a molecular weight of about 300 to about 30,000, as a glycol component comonomer, based on the weight of the polyethylene terephthalate copolymer.

20. The film unit as described in claim 19, wherein said film unit has a structure such that part of said dimensionally stable supports does not substantially come into contact with said aqueous processing solution even after said aqueous processing solution has been spread.

21. The film unit as described in claim 20, which has a structure such that at least part of the periphery of said dimensionally stable supports is strongly secured with a member which is not substantially swollen when in contact with said aqueous processing solution.

22. A composite diffusion transfer photographic film unit adapted for use in a photographic diffusion transfer process comprising:

(a) a photosensitive element comprising a dimensionally stable transparent support having thereon the following layers in sequence: an image-receiving layer; an alkaline solution-permeable, light-reflecting layer; an alkaline solution-permeable opaque layer; a red-sensitive silver halide emulsion layer having a cyan dye image-providing compound associated therewith; an interlayer; a green-sensitive silver halide emulsion layer having a magenta dye image-providing compound associated therewith; an interlayer; a red-sensitive silver halide emulsion layer having a yellow dye image-providing compound associated therewith; and a protective layer;

(b) a cover sheet superposed on said protective layer of said photosensitive element and comprising a dimensionally stable transparent support coated in sequence with a neutralizing layer and a neutralization timing layer; and (c) a rupturable container retaining an aqueous alkaline processing composition and an opacifying agent, said rupturable container being so positioned during the processing of said film unit that a compressive force applied to said rupturable container causes a discharge of said alkaline processing composition between said cover sheet and said protective layer of said photosensitive element, wherein at least one of said dimensionally stable transparent supports comprises a film of a polyethylene terephthalate copolymer containing about 3 to about 20% by weight of a polyalkylene glycol having a molecular weight of about 300 to about 30,000, as a glycol component comonomer, based on the weight of the polyethylene terephthalate copolymer.

23. The film unit as described in claim 22, wherein both said support of said photosensitive element and said support of said cover sheet are a film of said polyethylene terephthalate copolymer.

24. The film unit as described in claim 22, wherein said polyalkylene glycol has a molecular weight of about 800 to about 20,000.

25. The film unit as described in claim 24, wherein said polyalkylene glycol is present in a copolymerization ratio of 3 to 15% by weight.

26. The film unit as described in claim 25, wherein said film of a polyethylene terephthalate copolymer is a biaxially oriented film of said polyethylene terephthalate copolymer.

27. The film unit as described in claim 26, wherein said film of a polyethylene terephthalate copolymer has a water vapor permeability at 40° C. of about 10 to 100 $g/m^2$ 24 hr/0.1 mm and a humidity swelling coefficient at 20° C. of about $1.0\times10^{-5}$ to $6.0\times10^{-5}$/% RH.

28. In a cover sheet for use with a color diffusion transfer unit, which comprises a transparent support having coated thereon, in sequence, a neutralizing layer and a neutralization timing layer, the improvement which comprises said transparent support comprising a film of a polyethylene glycol having a molecular weight of about 300 to about 30,000, as a glycol component comonomer, based on the weight of the polyethylene terephthalate copolymer.

29. In a process of producing a photographic diffusion transfer image, comprising image-wise exposing the film unit as described in claim 19 and discharging said aqueous processing solution between said two supports.

30. A process of producing a photographic diffusion transfer image, comprising image-wise exposing a film unit as below described and discharging an aqueous processing solution between said two dimensionally stable transparent supports as below described wherein said film unit comprises:

(a) a photosensitive element comprising a dimensionally stable transparent support having thereon the following layers in sequence: an image-receiving layer; an alkaline solution-permeable, light-reflecting layer; an alkaline solution-permeable opaque layer; a red-sensitive silver halide emulsion layer having a cyan dye image-providing compound associated therewith; an interlayer; a green-sensitive silver halide emulsion layer having a magenta dye image-providing compound associated therewith; an interlayer; a red-sensitive silver halide emulsion layer having a yellow dye image-providing compound associated therewith; and a protective layer;

(b) a cover sheet superposed on said protective layer of said photosensitive element and comprising a dimensionally stable transparent support coated in sequence with a neutralizing layer and a neutralization timing layer; and (c) a rupturable container retaining an aqueous alkaline processing composition and an opacifying agent, said rupturable container being so positioned during the processing of said film unit that a compressive force applied to said rupturable container causes a discharge of said alkaline processing composition between said cover sheet and said protective layer of said photosensitive element;

wherein said image-wise exposing is through said cover sheet and wherein at least one of said dimensionally stable transparent supports comprises a film of a polyethylene terephthalate copolymer containing about 3 to about 20% by weight of a polyalkylene glycol having a molecular weight of about 300 to about 30,000, as a glycol component comonomer, based on the weight of the polyethylene terephthalate copolymer.

31. In a photographic element comprising a support, at least one silver halide emulsion layer having associated therewith a dye image-providing compound, an image receiving layer and a neutralizing layer, said element containing a neutralization timing layer between said neutralizing layer and said silver halide emulsion layer, the improvement comprising said support is a film of a polyethylene terephthalate copolymer containing about 3 to 20% by weight of a polyalkylene glycol having a molecular weight of about 300 to about 30,000, as a glycol component comonomer, based on the weight of the polyethylene terephthalate copolymer.

* * * * *